US007708074B2

(12) United States Patent
AlMubarak

(10) Patent No.: US 7,708,074 B2
(45) Date of Patent: May 4, 2010

(54) DOWNHOLE VALVE FOR PREVENTING ZONAL CROSS-FLOW

(75) Inventor: Saeed Mohammed AlMubarak, Safwa (SA)

(73) Assignee: Saudi Arabian Oil Company, Dhahran (SA)

( * ) Notice: Subject to any disclaimer, the term of this patent is extended or adjusted under 35 U.S.C. 154(b) by 248 days.

(21) Appl. No.: 11/855,836

(22) Filed: Sep. 14, 2007

(65) Prior Publication Data

US 2009/0071643 A1 Mar. 19, 2009

(51) Int. Cl.
*E21B 34/00* (2006.01)

(52) U.S. Cl. ..... 166/320; 166/334.1; 166/115; 137/512.1

(58) Field of Classification Search ..... 166/320, 166/334.1, 115; 137/512.1, 538, 533, 533.31
See application file for complete search history.

(56) References Cited

U.S. PATENT DOCUMENTS

| | | | | |
|---|---|---|---|---|
| 2,842,162 | A * | 7/1958 | Schwegman | 138/43 |
| 3,319,717 | A | 5/1967 | Chenoweth | |
| 3,381,708 | A | 5/1968 | Chenoweth | |
| 4,905,775 | A * | 3/1990 | Warren et al. | 175/38 |
| 5,068,674 | A * | 11/1991 | Sato et al. | 347/62 |
| 5,927,401 | A | 7/1999 | Morris et al. | |
| 6,079,494 | A | 6/2000 | Longbottom et al. | |
| 6,561,277 | B2 | 5/2003 | Algeroy et al. | |
| 6,612,547 | B2 | 9/2003 | Carmody et al. | |
| 6,918,452 | B2 * | 7/2005 | Chan et al. | 175/21 |
| 6,951,252 | B2 | 10/2005 | Restarick et al. | |

FOREIGN PATENT DOCUMENTS

| | | | |
|---|---|---|---|
| GB | 2376488 | A | 12/2002 |
| WO | 0106086 | A1 | 1/2001 |

OTHER PUBLICATIONS

International Search Report dated Dec. 18, 2008, 4 pages.
S., Mubarak, et al., "Integrating Advanced Production Logging and Near-Wellbore Modeling in a Maximum-Reservoir-Contact (MRC) Well", SPE International, Copyright 2007.

* cited by examiner

*Primary Examiner*—William P Neuder
*Assistant Examiner*—Nicole A Coy
(74) *Attorney, Agent, or Firm*—Bracewell & Giuliani LLP

(57) ABSTRACT

A flow control valve for use in a downhole completion tubing string, where the control valve prevents cross flow between producing zones. The control valve comprises a housing forming a plenum therein, a tubular member having a perforated end disposed in the housing, and a plug assembly disposed in the end of the tubular member having perforations. The plug assembly comprises a shaft reciprocatingly disposed in the tubular member. Produced fluids flow within the tubular member, through the perforations to the plenum, and outside of the control valve through corresponding perforations formed in the disk and housing. When pressure in the completion tubing string exceeds produced fluid pressure, the plug will close thereby preventing fluid flow from the completion tubing to the tubular member.

18 Claims, 4 Drawing Sheets

DOWNHOLE VALVE FOR PREVENTING ZONAL CROSS-FLOW

BACKGROUND OF THE INVENTION

1. Field of the Invention

This invention generally relates to the field of subterranean well completions and controlling flow of production fluid from wells comprising primary and lateral wells.

2. Description of the Related Art

In many instances, a hydrocarbon producing wellbore includes not only the primary well drilled into a subterranean formation, but also one or more lateral wells extending into the surrounding formation adjacent the primary wellbore. FIG. 1 provides a cross sectional view of an example of a wellbore production system 10 installed in a wellbore having lateral wells. In this example, the primary wellbore 5 extends from the surface and into a producing zone within a subterranean formation 6. The associated casing 7 cemented within the wellbore 5 extends substantially along the entire length of the wellbore and also into the formation 6. Perforations 11 formed through the side of the wellbore 5 and through the casing 7 into the surrounding formation 6 provide fluid pathways for production fluid (hydrocarbon gas and liquid) to flow into the wellbore 5. The wellbore production system 10 includes completion tubing 13 coaxially inserted within the casing 5. The completion tubing 13 extends along the length of the wellbore 5 up to the wellhead 14 and delivers the production fluid therein to the wellhead for distribution to a production line 16.

In addition to the production fluid from the subterranean formation 6, the lateral wellbores (3, 4) extend into corresponding production zones within corresponding subterranean formations (8, 9). These lateral wellbores (3, 4) also include perforations 11 providing fluid communication between the wellbore and their associated formation. In the embodiment of FIG. 1, the produced fluids from the primary wellbore 5 and the lateral wellbores (3, 4) are deposited into a single completion tubing 13 where these fluids are mixed. It should be pointed out that other configurations exist wherein dedicated tubing is provided to each production zone thereby preventing commingling of fluids within the wellbore 5. One disadvantage of installing dedicated tubing is the presence of additional hardware within the wellbore as well as the difficulty of introducing and maintaining the hardware in these individual circuits.

The producing zones (6, 8, 9) may operate or produce at varying pressures. To prevent an imbalanced pressure situation within the completion tubing 13, chokes (18, 20, 22) are provided in the fluid flow pathway between the respective producing zones and the completion tubing 13. Chokes provide a regulating effect on the fluid by adjusting the flow rate and pressure to compensate for pressure differences between these different producing zones. Also shown in FIG. 1 are packer seals 26 proximate to the junctions between the primary wellbore 5 and the laterals that seal the flow pathway between the annulus between the tubing 13 and casing 5 and forces fluid flow through perforations 24 in the tubing string 13 and through the respective chokes (18, 20, 22).

While existing chokes, or other flow control mechanisms regulate or adjust fluid flow and fluid pressure, these devices do not limit flow direction therethrough. Accordingly, in situations wherein pressure within the production tubing 13 may exceed pressure within a particular lateral wellbore or its associated producing zone, the fluid in the higher pressure tubing string may migrate into the production zone through any one of these known devices. This situation could occur if a flow regular of a high pressure producing zone fails or if the well is suddenly shut in and the respective valves are not closed prior to the shut in. Because migration of producing fluids from one zone into another zone having a different pressure may cause deleterious effects on the lower pressure formation, this is an undesired situation. Therefore, it would be advantageous to develop a device for preventing the cross flow of production fluids from producing zones having different pressures. It would also be advantageous to develop and implement a device that can regulate flow in addition to preventing cross flow of production fluids.

SUMMARY OF THE INVENTION

The device disclosed herein is a downhole control valve for use in a tubing completion string disposed in a wellbore. In one embodiment the control valve comprises a housing defining a plenum therein, a tubular member extending into the plenum and having a first end in the plenum. Also included is an aperture on a portion of the tubular member within the plenum, wherein the aperture is formed through the side of the tubular member and a plug assembly. The plug assembly includes a disk having a shaft extending therefrom wherein the shaft is coaxially disposed within the first end of the tubular member, and wherein the plug assembly is reciprocatingly slideable within the tubular member in response to a pressure differential on the disk. The tubular member is in pressure communication with a corresponding downhole producing zone.

In one mode of operation of the control valve, the plug assembly is slideable into a first position urging the shaft adjacent the aperture thereby blocking fluid flow through the aperture. In another operational mode of the control valve, the plug assembly is slideable into a second position urging the shaft away from the aperture thereby allowing fluid flow through the aperture.

Optionally, a lip may be formed on an end of the housing, wherein the lip radially extends inward towards the housing axis and the lip retains the plug assembly within the plenum. A first perforation may be formed on the disk and a corresponding second perforation formed on the lip, wherein the first and second perforations are substantially aligned thereby providing a flow path from the plenum to the outside of the housing through the perforations. Additional apertures may be formed on the tubular member.

The present disclosure also includes a completion system disposed within a subterranean wellbore having more than one producing zone. The completion system comprises a tubing string and a control valve. The control valve comprises, a housing, a plenum within the housing, a tubular member extending into the plenum, an aperture formed through the member wall on a portion of the member within the plenum, and a plug coaxially disposed in the end of the tubular member within the plenum in sliding response to pressure differences between a corresponding producing zone and pressure in the tubing string.

The plug is configured to slidingly respond to a closed position when the pressure in the tubing string exceeds the corresponding producing zone pressure. The plug is also configured to slidingly move to an open position when the first producing zone pressure exceeds the pressure in the tubing string thereby allowing fluid flow from the first producing zone into the tubing string. The control valve also regulates fluid flow into the production string. The completion system may comprise a second control valve

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAIL DESCRIPTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

The device and system described herein is useful for preventing cross flow or migration of production fluids between different producing zones. In one embodiment the device comprises a control valve disposed in the flow path between a subterranean zone producing a hydrocarbon fluid and a tubing completion string. The device is configured to allow flow from its corresponding producing zone into the completion string, but to prevent migration flow from fluid within the completion string into the corresponding producing zone. If the completion string pressure exceeds the pressure of a producing zone, it is likely due to another producing zone communicating with the completion string is at a pressure higher than the first producing zone. Therefore, the control valve and device disclosed herein provides a zonal isolation function between different producing zones of the same wellbore circuit.

Figure 2:
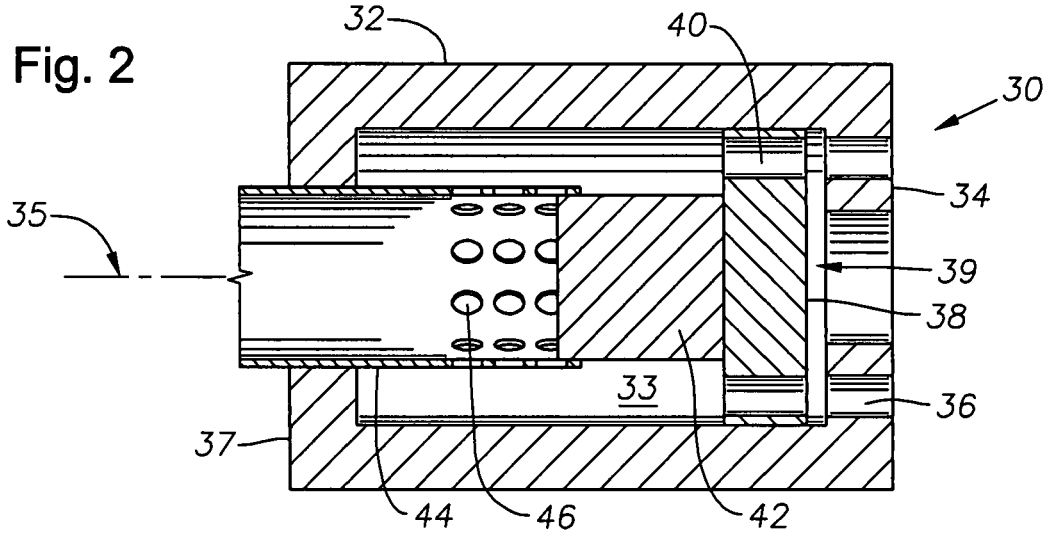
FIG. 2 shows in side partial cross sectional view an example of a control valve.

With reference now to FIG. 2, one embodiment of a control valve 30 in accordance with the present disclosure is shown in a side partial cross sectional view. The control valve 30 comprises a generally hollow housing 32 forming a plenum 33 therein. The housing 32 is closed on its rear wall 37 and generally open on the opposite end. A tubular member 44 is shown extending into the plenum 33 through the rear wall 37. Apertures 46 are formed through the wall of the tubular member 44 thereby communicating the inner confines of the tubular member 44 to the plenum 33. The first end of the tubular member 44 terminates within the plenum 33 wherein the second end (not shown) of the member 44 is in fluid communication with a corresponding production zone of a subterranean formation.

Figure 2A:
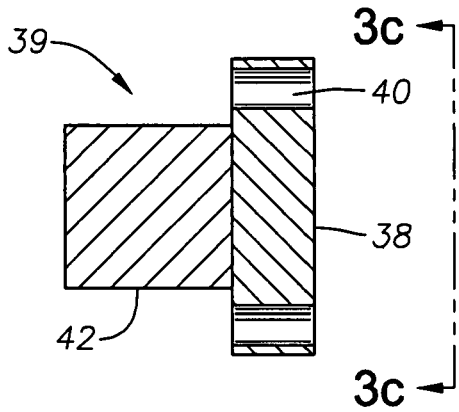

Slidingly disposed within the open first end of the tubular member 44 is a plug assembly 39. The plug assembly 39, also shown in cross sectional view in FIG. 2*a*, comprises a disk 38 with a shaft 42 extending from one side of the disk 38. Perforations 40 are formed through the disk 38 that are substantially parallel to the disk axis. A lip 34 is formed on the open end of the housing 32. Perforations 36 are formed through the lip that are substantially parallel with the axis 35 of the control valve 30. In the embodiment of FIG. 2, it is shown that the perforations 40 of the disk 38 are in substantial alignment with the perforations 36.

Figure 3A:
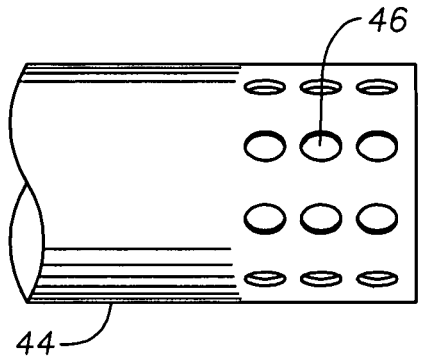
FIGS. 3*a*-3*e* show side and frontal views of components of a control valve.
Figure 3B:
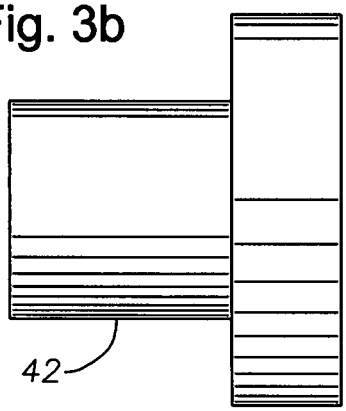
Figure 3C:
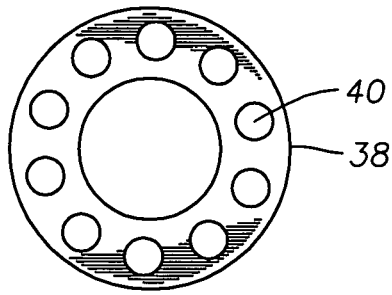
Figure 3D:
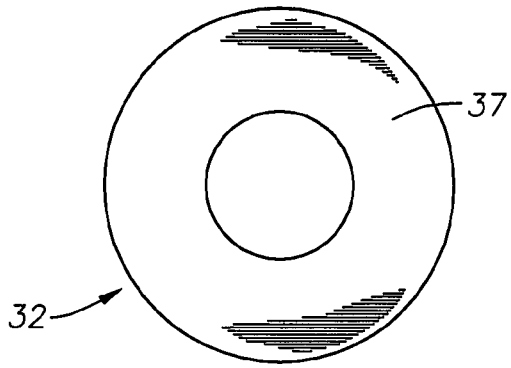
Figure 3E:
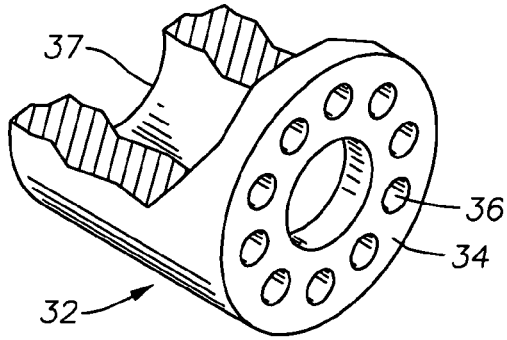

FIGS. 3*a*-3*c* illustrate a side view of the tubular member 44 and side and front views of plug assembly 39 components. With reference now to FIG. 3*a*, a portion of the tubular member 44 is shown in a side view illustrating perforations 46 formed through the wall of the tubular member 44. In FIG. 3*b*, a side view of the shaft 42 is shown; as discussed above, the shaft is formed to coaxially slide within the annular confines of tubular member 44. In one embodiment, the shaft 42 may be a Boston shaft obtainable from Boston Gear at 14 Hayward Street, Quincy, Mass. 02171, phone 617-328-3300. FIG. 3*c* illustrates the frontal view of the disk 38 having perforations 40 formed therethrough at substantially the same radial distance from the center of the disk 38. FIG. 3*d* is a rear view of the rear wall 37 illustrating an embodiment where the control valve 32 has a substantially cylindrical configuration. FIG. 3*e* is a perspective view of a cutaway portion of the control valve 32. In this embodiment, the lip 34 is shown having perforations 36 formed at roughly the same radial distance from the center of the lip 34.

Figure 1:
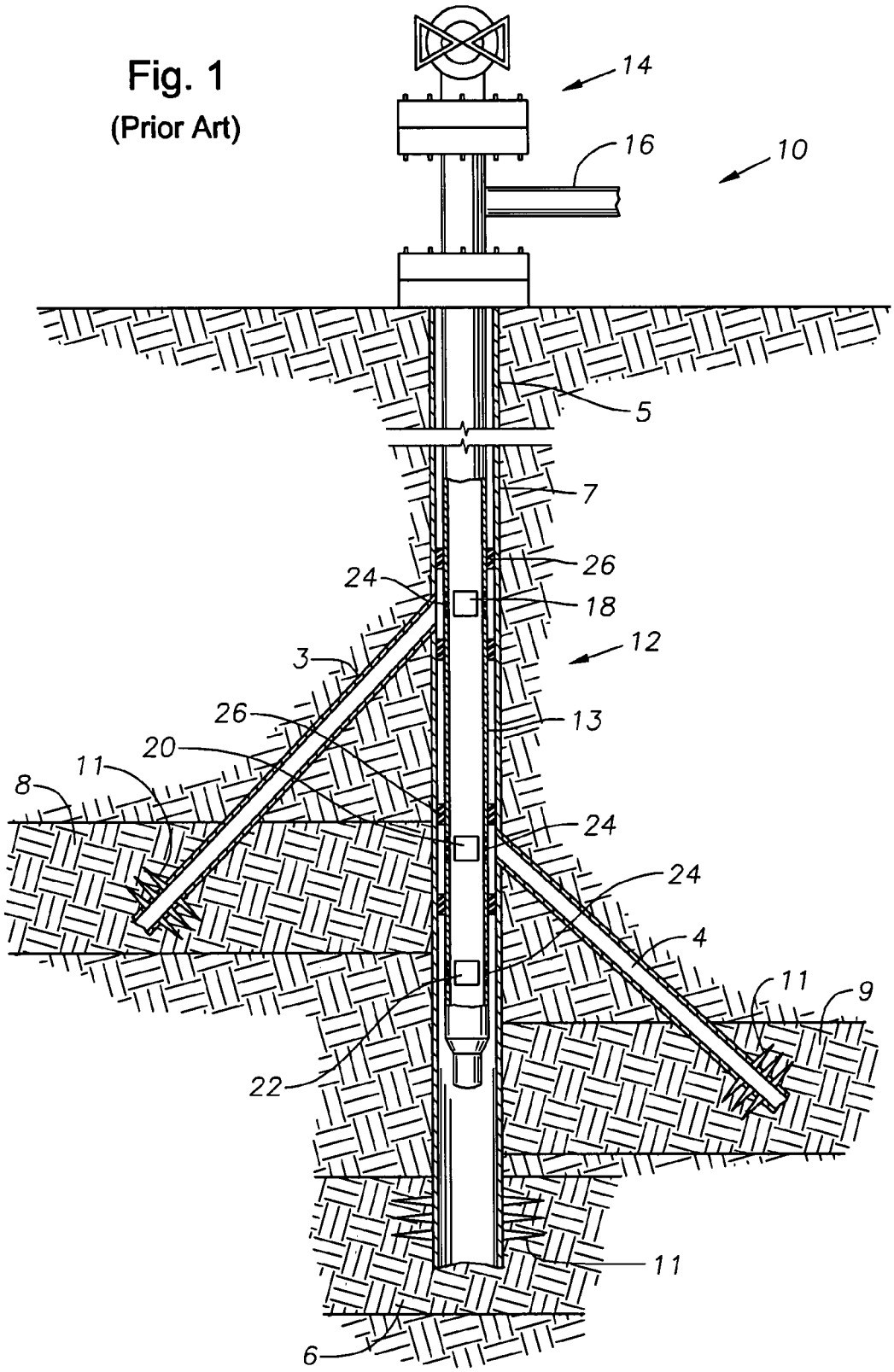
Fig. 1 (Prior Art)
FIG. 1 shows a prior art well production system.

As noted above, the control valve 30 described herein is primarily for use within a tubing completion string, such as that illustrated in FIG. 1. Accordingly, the scope of the present disclosure includes completion strings having multiple control valves. In one embodiment, a control valve as described herein is included with the completion string and disposed in the flow path between producing zones and the completion string. The tubular member 44 of each control valve 30 thus is in fluid and pressure communication with its corresponding producing zone and the disk outer surface is in pressure communication with the completion string. Thus, pressure differences or gradients between the corresponding producing zone and the completion string pressure exerted on the disk outer surface dictates the position of the plug assembly 39.

Figure 4A:
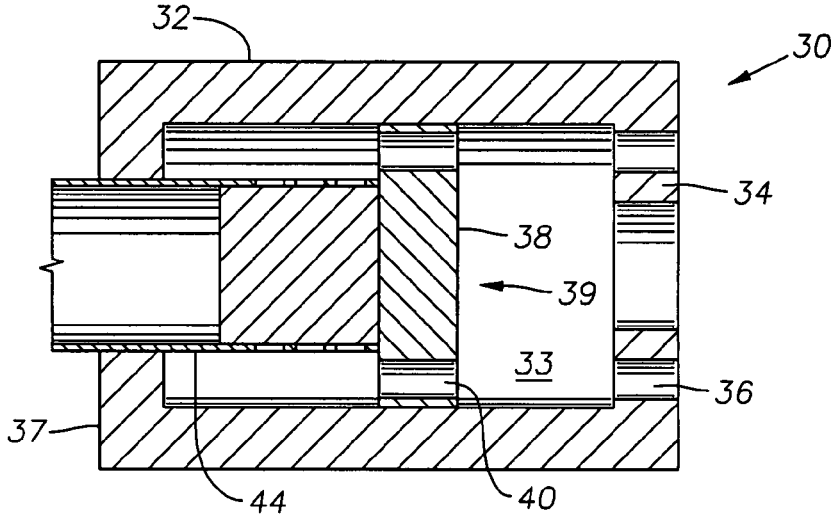
FIGS. 4*a*-4*d* show operational modes of a control valve in accordance with the disclosure.

FIGS. 4*a*-4*d* illustrate an operational sequence of an embodiment of the control valve of the present disclosure. FIG. 4*a* provides a partial cross sectional view of the control valve 30 wherein the position of the plug assembly 39 is fully inserted within the tubular member 44. This configuration, also referred to herein as a first or a closed position, has the disk 38 substantially flush with the terminal end of the tubular member within the plenum 33. In the closed position the shaft 42 extends into the tubular member 44 residing adjacent each of the apertures 46. Thus, the closed or first position of the control valve 30 blocks fluid and pressure communication between the inner confines of the tubular member and the plenum 33. When in the closed position, the pressure within the associated completion tubing string exceeds the pressure within the tubular member 44 and thus also exceeds the pressure within the corresponding producing zone in communication with the tubular member 44.

Figure 4B:
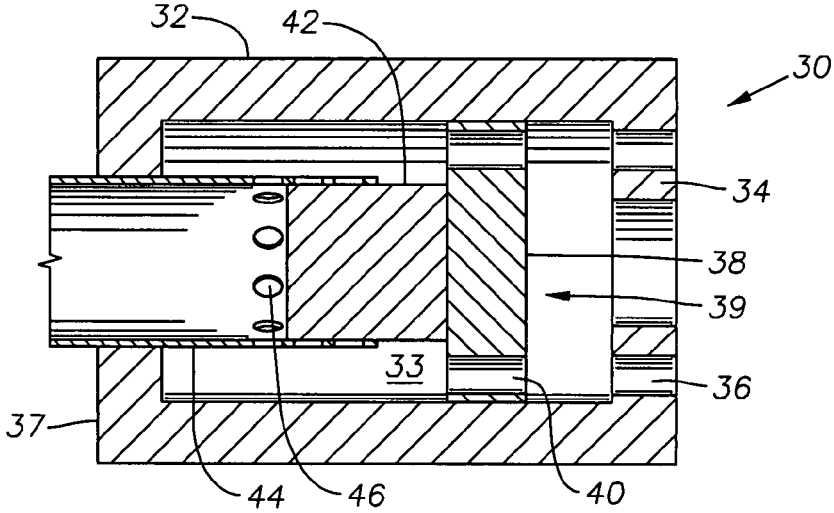
Figure 4C:
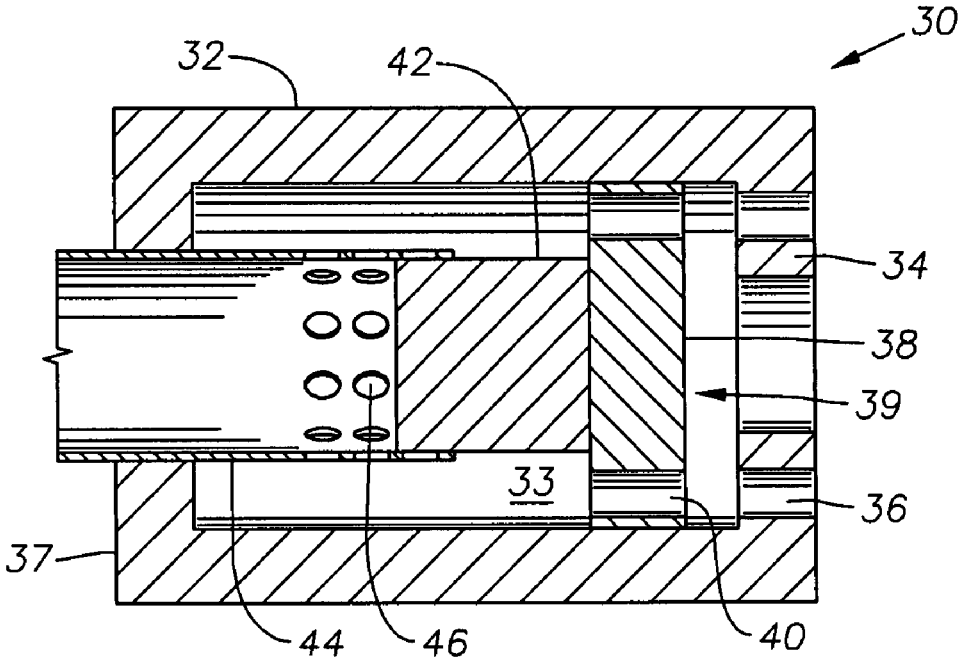
Figure 4D:
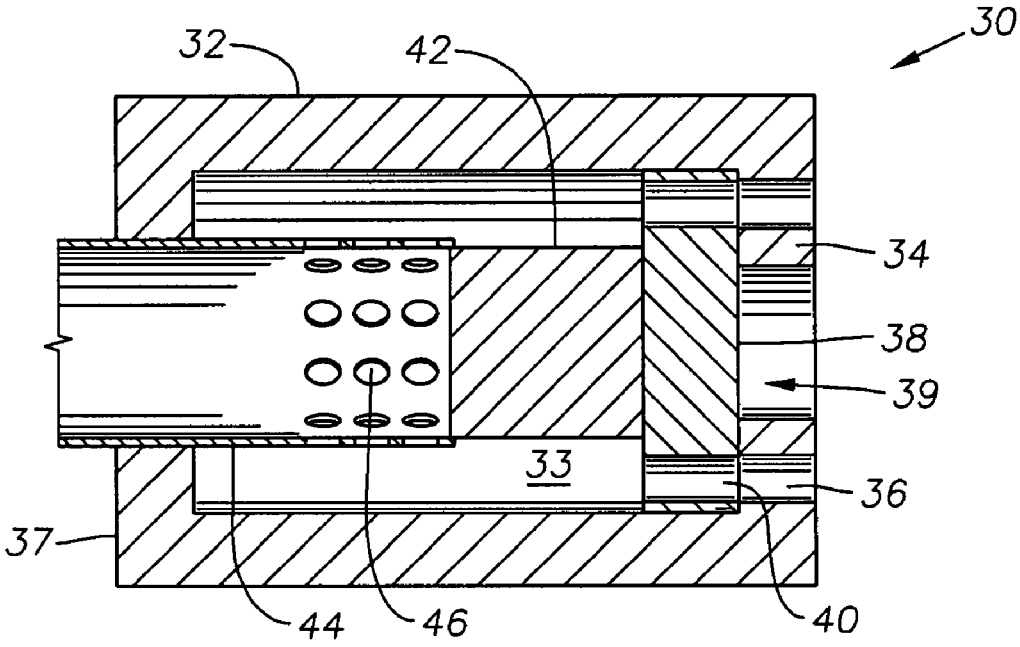

FIGS. 4*b*-4*d* illustrate the condition when the pressure in the tubular member 44 (and thus its corresponding producing zone) exceeds the completion string pressure thereby slidingly urging the disk 38 away from the tubular member 44. With reference now to FIG. 4*b*, the plug assembly 39 is moving from its position in FIG. 4*a* away from the terminal end of the tubular member 44 towards the lip 34. Additionally the shaft 42 has moved away from a first row of perforations 46 thereby initiating pressure and fluid communication between the inner confines of the tubular member 44 and the plenum 33. FIG. 4*c* illustrates further movement of the plug assembly 39 within the plenum 33 towards the lip 34. Ultimately, as shown in FIG. 4*d*, the increased pressure of the corresponding producing zone over that of the inside of the completion string fully urges the plug assembly 39 into substantial mating contact with the lip 34. In this configuration, it can be seen that the perforations 40 are substantially aligned with perforations 36. Thus in the open, or second position illustrated in FIG. 4*d*, full fluid and pressure communication would exist between the plenum 33 and the inner portion of a production/completion tubing string. FIGS. 4*b* and 4*c* represent intermediate positions of the plug assembly between the open and closed positions. As illustrated and described herein the control valve 30 is a passive device responsive to pressure differentials across the opposing surfaces of the disk 38 and may reciprocate between the open and closed positions by the sliding action described above.

In normal operation while in the producing mode of the hydrocarbon bearing formation and associated wellbore, the apertures 46 combined with flow through the plenum and perforations (40, 36) provide a regulating pressure drop. It may be necessary to regulate the fluid flow when a wellbore production circuit comprises multiple lateral producing bores in addition to the primary wellbore. The regulating ability of the control valve 30, when disposed in relation to each producing wellbore of the well system, can regulate pressure within the completion tubing without hindering production of other lateral wellbores.

The present device also has benefits in situations where production of the well is ceased for a period of time. In some instances well having multiple lateral wellbores may be shut in allowed to "settle out". Settling out occurs by communicating all interconnected producing zones through the completion string without regulating or reducing pressure between the producing zone and the completion string. This exposes the lower pressure producing zones to the highest pressure producing zone; and if unchecked, enables high pressure zone production fluid to migrates into lower pressure zones. Implementation of the control valve disclosed herein reacts to such pressure differentials by pushing the plug assembly into the closed or first position as shown in FIG. 4*a*. The control valve 30 in the closed position blocks high pressure fluid from migrating into its corresponding producing zone. Accordingly, the passive system herein described has great advantages over present known systems that may require a manual valve closure prior to a shut in. Moreover, manual closure is not always possible since some shut in conditions occur with little or no warning.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A downhole control valve for use in a tubing completion string disposed in a wellbore, the control valve comprising:

a housing defining a space therein in fluid communication with a completion string in a wellbore;

a tubular member in fluid communication with a subterranean formation and having a first end in the space;

an aperture formed through a side wall of the tubular member and within the space adjacent the first end; and a plug assembly coaxially disposed within the first end of the tubular member and in response to a pressure differential between the tubular member and the completion string slideable between a first position adjacent the aperture, so that fluid communication between the tubular member and the space is blocked, and a second position away from the aperture, so that the space and tubular member are in fluid communication.

2. The control valve of claim 1, wherein the plug assembly comprises a substantially cylindrical shaft portion that is slideable within the tubular member, a terminal end of the tubular member disposed within the housing in which the shaft is received, an opening on the housing in fluid communication with the completion tubing, a disk coaxially mounted on an end of the shaft, wherein the disk is substantially adjacent the terminal end of the tubular member and away from the opening when the plug assembly is in the first position, and away from the terminal end and adjacent the opening when the plug assembly is in the second position.

3. The control valve of claim 2, further comprising a lip formed on an end of the housing that projects radially inward towards the housing axis space so that when the plug assembly is in the second position, the lip is contactable by the disk.

4. The control valve of claim 3 further comprising a first perforation formed on the disk and a corresponding second perforation formed on the lip, wherein the first and second perforations are substantially aligned thereby providing a flow path from the space to the outside of the housing through the perforations.

5. The control valve of claim 1, wherein fluid is within the formation and is flowable along a flow path that extends through the tubular member, through aperture into the space, around the plug assembly, and to the completion string.

6. The control valve of claim 1 further comprising additional apertures formed on the tubular member.

7. The control valve of claim 1, wherein the tubular member is in pressure communication with a downhole producing zone.

8. The control valve of claim 7 disposed within the completion tubing string, wherein the control valve regulates flow from the downhole producing zone into the completion tubing string.

9. The control valve of claim 1, wherein the disk comprises an inner surface and an outer surface, wherein the disk outer surface is in pressure communication with the space outside of the control valve.

10. A completion system disposed within a subterranean wellbore having more than one producing zone, the completion system comprising:

a tubing string; and a control valve comprising:

a housing, a space within the housing, a tubular member in fluid communication with a corresponding producing zone and having a portion with an end that extends into the space, an aperture formed though the member wall on a portion of the tubular member within the space, and a plug having a section coaxially within the portion of the tubular member within the space and slidable to and from a first position in a flow path between the aperture and inside of the tubular member wherein fluid communication between the tubular member and the space is blocked and a second position away from the aperture in response to pressure differences between the corresponding producing zone and pressure in the tubing string.

11. The completion system of claim 10 wherein the plug inner surface is in pressure communication with a first producing zone.

12. The completion system of claim 11 wherein the plug outer surface is in pressure communication with tubing string pressure.

13. The completion system of claim 12, wherein the plug is configured to slidingly respond to a closed position when the pressure in the tubing string exceeds the first producing zone pressure.

14. The completion system of claim 13, wherein the pressure differential between the first producing zone and the tubing string is sufficient for fluid in the tubing string to migrate to the first producing zone.

15. The completion system of claim 12, wherein the plug is configured to slidingly respond to an open position when the first producing zone pressure exceeds the pressure in the tubing string thereby allowing fluid flow from the first producing zone into the tubing string.

16. The completion system of claim 15, wherein the control valve regulates fluid flow pressure.

17. The completion system of claim 15, further comprising a second control valve comprising a housing, a space within the housing, a tubular member extending into the space, an aperture formed through the member wall on a portion of the member within the space, and a plug coaxially disposed in the end of the tubular member within the space in sliding response to pressure differences between a second corresponding producing zone and the pressure within the tubing string.

18. The completion system of claim 15, wherein the second control valve wherein the plug liner surface is in pressure communication with the second producing zone and the plug outer surface is in pressure communication with the tubing string.

* * * * *

UNITED STATES PATENT AND TRADEMARK OFFICE

CERTIFICATE OF CORRECTION

PATENT NO. : 7,708,074 B2
APPLICATION NO. : 11/855836
DATED : May 4, 2010
INVENTOR(S) : Saeed Mohammed AlMubarak It is certified that error appears in the above-identified patent and that said Letters Patent is hereby corrected as shown below:

Column 6, line 36, insert --the-- between "through" and "aperture"

Column 8, line 15, delete "15" and insert --17--
Column 8, line 15, insert --the plug of-- before "the second"
Column 8, line 16, delete "wherein the plug liner surface is" and insert --has a plug inner surface--
Column 8, line 17, delete "the" before "plug" and insert --a--
Column 8, line 18, delete "is" before "in pressure"

Signed and Sealed this

Seventeenth Day of August, 2010

David J. Kappos

David J. Kappos
*Director of the United States Patent and Trademark Office*